US012345144B2

(12) United States Patent
Publes et al.

(10) Patent No.: US 12,345,144 B2
(45) Date of Patent: Jul. 1, 2025

(54) AUTOMATICALLY CONTROLLING A POWER RAMP RATE OF A MOTOR OF A PUMP SYSTEM

(71) Applicant: Caterpillar Inc., Peoria, IL (US)

(72) Inventors: Andy Publes, Katy, TX (US); Mark Francis Grimes, Cypress, TX (US); Riadh Benguedda, Cypress, TX (US); Yuesheng He, Sugar Land, TX (US); Mark C Paul, Carmel, IN (US); Todd Ryan Kabrich, Tomball, TX (US)

(73) Assignee: Caterpillar Inc., Peoria, IL (US)

( * ) Notice: Subject to any disclaimer, the term of this patent is extended or adjusted under 35 U.S.C. 154(b) by 600 days.

(21) Appl. No.: 17/654,515

(22) Filed: Mar. 11, 2022

(65) Prior Publication Data

US 2023/0287775 A1 Sep. 14, 2023

(51) Int. Cl.

| | |
|---|---|
| ***E21B 43/26*** | (2006.01) |
| ***F04B 49/06*** | (2006.01) |
| ***F04B 49/20*** | (2006.01) |

(52) U.S. Cl.

CPC ..... *E21B 43/2607* (2020.05); *F04B 49/065* (2013.01); *F04B 49/20* (2013.01); *F04B 2203/0204* (2013.01)

(58) Field of Classification Search

CPC .... E21B 43/2607; F04B 49/20; F04B 49/065; F04B 2203/0204

See application file for complete search history.

(56) References Cited

U.S. PATENT DOCUMENTS

| | | | | |
|---|---|---|---|---|
| 5,409,101 | A * | 4/1995 | Ahmed | H02K 33/16 198/750.1 |
| 6,414,455 | B1 * | 7/2002 | Watson | H02P 27/06 417/18 |
| 7,680,562 | B2 * | 3/2010 | Delmerico | H02J 3/06 700/297 |
| 7,800,339 | B2 * | 9/2010 | Gonzalez | H02P 23/0004 318/807 |
| 9,312,779 | B2 * | 4/2016 | Liu | H02M 1/126 |
| 10,101,070 | B2 * | 10/2018 | West | F25B 1/04 |
| 10,174,980 | B2 * | 1/2019 | Beckmann | F04B 35/04 |
| 10,487,813 | B2 * | 11/2019 | Mueller | F04B 49/106 |
| 10,686,301 | B2 | 6/2020 | Oehring et al. | |
| 11,018,610 | B2 * | 5/2021 | Chedygov | H02K 9/18 |
| 2013/0321040 | A1 * | 12/2013 | Johal | H02J 3/144 327/113 |
| 2021/0032961 | A1 | 2/2021 | Hinderliter et al. | |
| 2021/0131248 | A1 | 5/2021 | Hinderliter et al. | |
| 2021/0301630 | A1 | 9/2021 | Krippner et al. | |

FOREIGN PATENT DOCUMENTS

| | | | |
|---|---|---|---|
| WO | WO-2018106513 A1 * | 6/2018 | B81B 7/008 |

OTHER PUBLICATIONS

Wikipedia, "Scada", 2019.*

* cited by examiner

*Primary Examiner* — Christopher S Bobish

(57) ABSTRACT

A controller that is associated with a pump system causes a power ramp rate of a motor of the pump system to have an initial power ramp rate. The controller monitors, after causing the power ramp rate of the motor to have the initial power ramp rate, a frequency of a power bus. One or more power sources provide power to the pump system via the power bus. The controller causes, based on monitoring the frequency of the power bus, the power ramp rate of the motor to be modified.

20 Claims, 3 Drawing Sheets

AUTOMATICALLY CONTROLLING A POWER RAMP RATE OF A MOTOR OF A PUMP SYSTEM

TECHNICAL FIELD

The present disclosure relates generally to hydraulic fracturing systems and, for example, to controlling a power ramp rate of a motor of a pump system of a hydraulic fracturing system.

BACKGROUND

Hydraulic fracturing is a well stimulation technique that typically involves pumping hydraulic fracturing fluid into a wellbore (e.g., using one or more well stimulation pumps) at a rate and a pressure (e.g., up to 15,000 pounds per square inch) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

A hydraulic fracturing system may include one or more power sources for providing power to components (e.g., the pumps) of the hydraulic fracturing system. A motor may be configured to drive each pump, and a ramp-up of the pump (e.g., to provide an increase fluid flow rate and/or flow pressure) may increase a power demand of the hydraulic fracturing system. In some cases, a power ramp rate of the motor (to ramp up the pump) is too great (e.g., an instantaneous power demand of the pump increases an overall power demand of the hydraulic fracturing system such that it exceeds a power supply of the one or more power sources), which causes the power sources to become overloaded. This leads to a power failure (e.g., a brownout or a blackout) of the one or more power sources. As a result of the power failure, pressure and fluid flow may be lost at the well. This type of uncontrolled shutdown may damage the hydraulic fracturing system, the one or more components of the hydraulic fracturing system, the well, and/or the like.

To avoid an uncontrolled shutdown caused by a power failure, some hydraulic fracturing systems may include one or more additional power sources (e.g., additional generator sets or energy storage units). The additional power sources may operate to increase an available power supply to the hydraulic fracturing system, such that an instantaneous power demand (e.g., based on a pump ramp-up) does not exceed the available power supply. Consequently, use of the additional power sources is superfluous for many periods of operation of the hydraulic fracturing system (e.g., periods that are not associated with a pump ramp-up), which wastes fuel resources, increases emissions of the hydraulic fracturing system, and increases wear on equipment of the additional power sources. Further, some hydraulic fracturing systems limit a power ramp rate of a motor of a pump to prevent a high instantaneous power demand of the motor, which decreases a performance of the motor, the pump, and the hydraulic fracturing system.

The control system of the present disclosure solves one or more of the problems set forth above and/or other problems in the art.

SUMMARY

In some implementations, a system for hydraulic fracturing includes a pump system that includes: a fluid pump, a motor configured to drive the fluid pump, and a variable frequency drive (VFD) configured to control the motor; one or more power sources configured to provide power to the pump system via a power bus; and a controller configured to: identify initiation of a ramp up period of the fluid pump; cause, based on identifying the initiation of the ramp up period of the fluid pump and via the VFD, a power ramp rate of the motor to have an initial power ramp rate; monitor, during the ramp up period of the fluid pump, a frequency of the power bus; determine, based on monitoring the frequency of the power bus, whether the frequency of the power bus satisfies a frequency threshold; and cause, based on determining that the frequency of the power bus satisfies the frequency threshold, and via the VFD, a decrease of the power ramp rate of the motor.

In some implementations, a method includes causing, by a controller associated with a pump system, a power ramp rate of a motor of the pump system to have an initial power ramp rate; monitoring, by the controller, after causing the power ramp rate of the motor to have the initial power ramp rate, a frequency of a power bus, wherein one or more power sources provide power to the pump system via the power bus; and causing, based on monitoring the frequency of the power bus, the power ramp rate of the motor to be modified.

In some implementations, a controller includes one or more memories; and one or more processors configured to: cause respective power ramp rates associated with a plurality of pump systems to have an initial power ramp rate; monitor, by the controller, after causing the respective power ramp rates associated with the plurality of pump systems to have the initial power ramp rate, a frequency of a power bus, wherein one or more power sources provide power to the plurality of pump systems via the power bus; and cause, based on monitoring the frequency of the power bus, a power ramp rate associated with at least one pump system, of the plurality of pump systems, to be modified.

DETAILED DESCRIPTION

Figure 1:
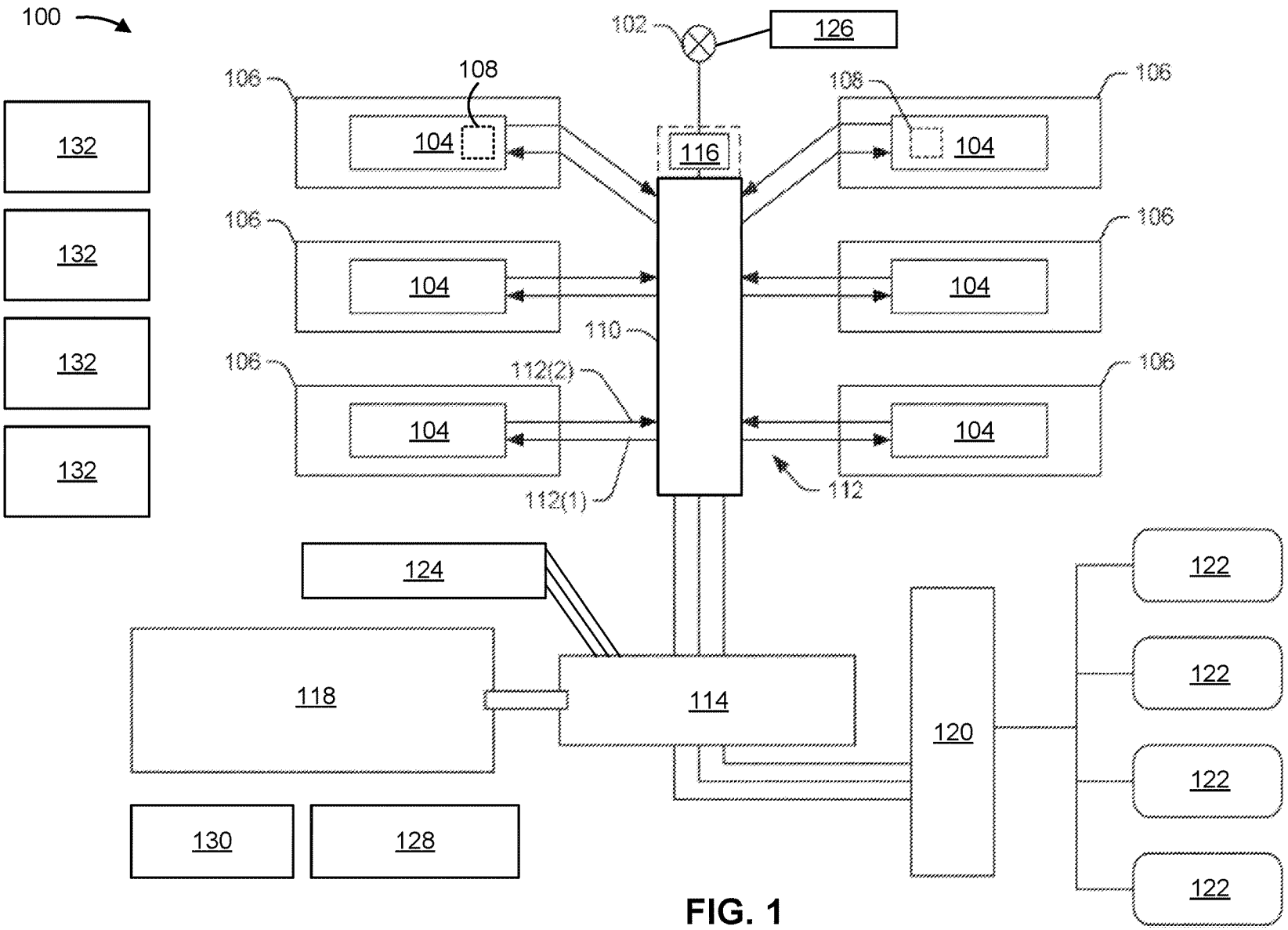
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. As described above, hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of hydraulic fracturing trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells. The fluid pumps 108, the fluid conduits 112, the manifold 110, and/or the fracturing head 116 may define a fluid system of the hydraulic fracturing system 100.

The blender 114 combines proppant (e.g., and or a similar particulate material suspended in water or other fluid) received from a proppant storage unit 118 with fluid received from a hydration unit 120 of the hydraulic fracturing system 100. In some examples, the proppant storage unit 118 may include a dump truck, a truck with a trailer, one or more silos, or other type of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van or a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 is in communication (e.g., by a wired connection or a wireless connection) with the pump systems 104 of the hydraulic fracturing trailers 106. The controller 130 may also be in communication with other equipment and/or systems of the hydraulic fracturing system 100. The controller 130 may include one or more memories, one or more processors, and/or one or more communication components. The controller 130 (e.g., the one or more processors) may be configured to control respective power ramp rates associated with the pump systems 104, as described herein in connection with FIG. 2.

The hydraulic fracturing system 100 may include one or more power sources 132. The power sources 132 may be in communication with the controller 130. For example, the controller 130 may control activation or deactivation of the power sources 132. Among other examples, the power sources 132 may include an electrical utility grid, an electrical microgrid, one or more turbines, one or more generator sets, one or more energy storage devices (e.g., batteries), one or more renewable energy systems (e.g., wind energy systems, solar energy systems, hydroelectric energy systems, or the like), or a combination thereof.

As indicated above, FIG. 1 is provided as an example. Other examples may differ from what is described with regard to FIG. 1.

Figure 2:
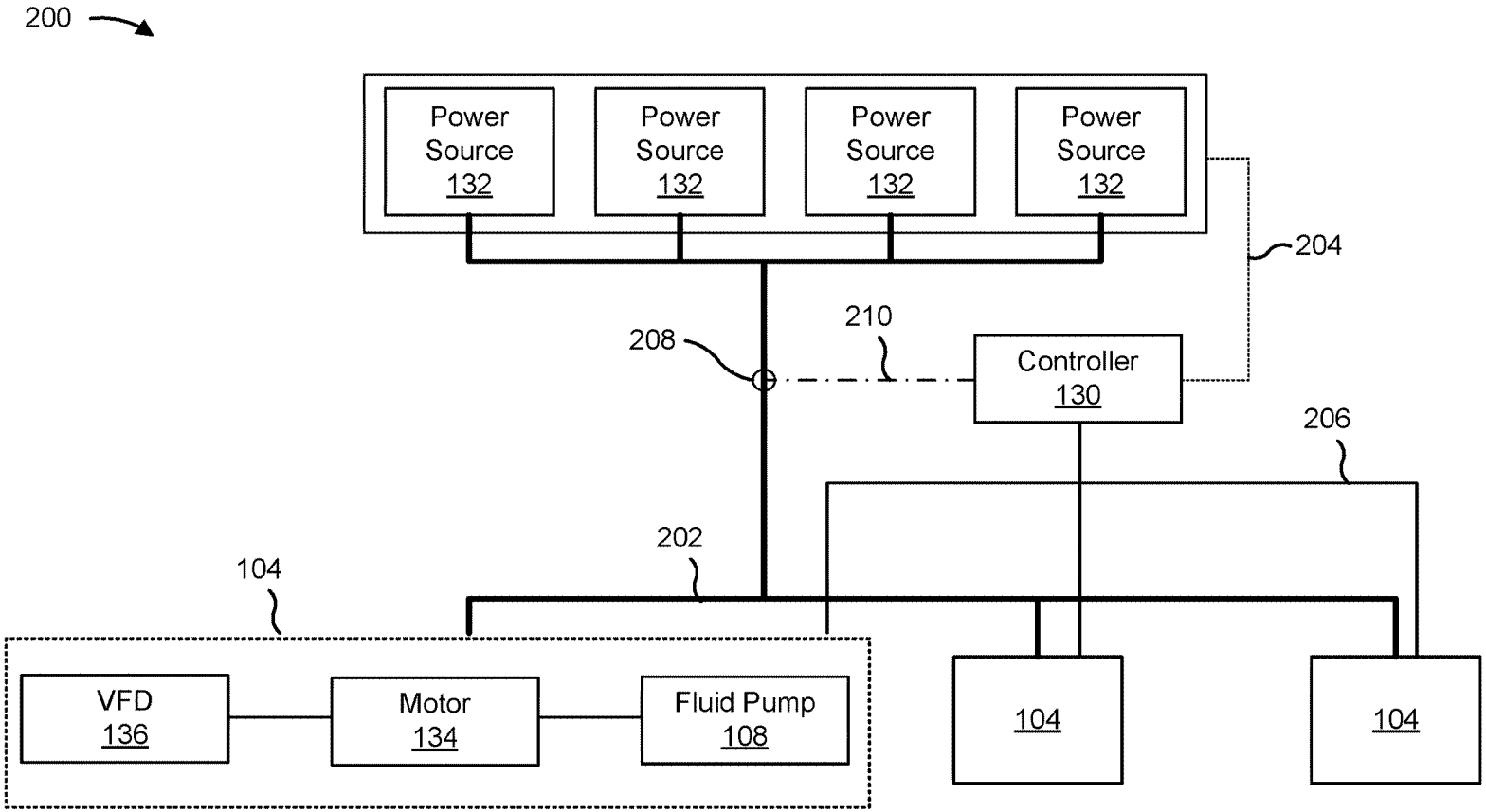
FIG. 2 is a diagram illustrating an example control system.

FIG. 2 is a diagram illustrating an example control system 200. The control system 200 may include one or more components of the hydraulic fracturing system 100, as described herein.

The control system 200 includes one or more pump systems 104. As described herein, pressurized fluid from each of the pump systems 104 may be combined at the manifold 110. Each pump system 104 includes a fluid pump 108, as described herein. Each pump system 104 also includes a motor 134 configured to drive (e.g., via a driveshaft) the fluid pump 108. The motor 134 may include an electric motor (e.g., an alternating current (AC) electric motor), such as an induction motor or a switched reluctance motor. In some examples, the fluid pump 108 and the motor 134 may share a housing. Each pump system 104 also includes a variable frequency drive (VFD) 136 that controls the motor 134. For example, the VFD 136 includes an electro-mechanical drive system configured to control a speed and/or a torque of the motor 134 by varying an input frequency and/or input voltage to the motor 134.

As shown in FIG. 2, the control system 200 includes one or more power sources 132, which are generating, or otherwise contributing, electrical power. Power provided by the power sources 132 may be combined prior to distribution to other components that use electricity. The combined power of the power sources 132 represents an available power supply of the hydraulic fracturing system 100. As shown, power provided by the power sources 132 may be distributed to the pump systems 104 via a power bus 202. Moreover, the blender 114, the hydration unit 120, the balancing pump 126, and/or the data monitoring system 128, among other examples, of the hydraulic fracturing system 100 may receive power from the power sources 132. During operation of the hydraulic fracturing system 100, power requirements for operating the pump systems 104 and other power-consuming components of the hydraulic fracturing system 100 (e.g., the blender 114, the hydration unit 120, the balancing pump 126, and/or the data monitoring system 128) represent a current (e.g., instantaneous) power demand or power load of the hydraulic fracturing system 100. In some implementations, the current power demand may include an amount of power associated with a commanded power increase (e.g., a commanded increase of a flow rate of the fluid pumps 108) that has yet to be carried out.

As shown in FIG. 2, the control system 200 includes the controller 130. The controller 130 may be configured to perform operations associated with controlling respective power ramp rates of one or more pump systems 104, as described herein. A "power ramp rate" may refer to a change in an amount of power (e.g., in kilowatts (kW)) provided over time (e.g., in seconds or minutes) to a pump system 104 (e.g., to a motor 134 of the pump system 104). The controller 130 may be a local controller for a pump system 104 or a system-wide controller for a plurality of pump systems 104. The controller 130 may be in communication with the power sources 132 (e.g., via a first communication bus 204) and the pump systems 104 (e.g., via a second communication bus 206). For example, the controller 130 may obtain power management configuration information (e.g., that indicates a type of power available from the power sources 132, an amount of power available from the power sources 132, and/or similar information) from the power sources 132. Moreover, the controller 130 may transmit a signal to a pump system 104 (e.g., a VFD 136 of the pump system 104) to control a power ramp rate of a motor 134 of the pump system 104.

In some implementations, the controller 130 may obtain a setting for a flow rate for fluid pumps 108 of the pump systems 104. The setting for the flow rate may indicate a commanded flow rate for the fluid pumps 108. In some implementations, the controller 130 may obtain the setting for the flow rate from a local or a remote memory or other storage, from another device, or the like, in a similar manner as described above. Additionally, or alternatively, to obtain the setting for the flow rate, the controller 130 may receive an input (e.g., an operator input) that indicates the setting for the flow rate. The controller 130 obtaining the setting for the flow rate may trigger a ramp-up of the fluid pumps 108 (e.g., by increasing a motor speed of the motors 134 that drive the fluid pumps 108), thereby increasing a power demand of the hydraulic fracturing system 100. The controller 130 may identify (e.g., based on the setting for the flow rate and/or triggering the ramp up the fluid pumps 108) initiation of a ramp up period of the fluid pumps 108. "Ramp up period" may refer to a period of time in which a fluid pump 108 is increasing flow rate from a lower flow rate (e.g., 0 gallons per minute or barrels per minute) to a higher flow rate (e.g., a commanded flow rate, a target flow rate, a maximum flow rate, or the like). Accordingly, the controller 130 may control respective power ramp rates of the motors 134 of the pump systems 104 associated with the fluid pumps 108 (e.g., to avoid overloading the power sources 132), as described herein.

In some implementations, the controller 130 may determine an initial power ramp rate for the pump systems 104 (e.g., for the motors 134 of the pump systems 104). The initial power ramp rate may be a power ramp rate for increasing a motor speed of each motor 134 of the pump system 104, and therefore for obtaining the commanded flow rate for the fluid pumps 108 of the pump systems 104. In some implementations, the controller 130 may determine the initial power ramp rate using a look-up table, an artificial intelligence model (e.g., a machine learning model), or a similar technique (e.g., that is based on a configuration of the power sources 132). In a particular example, the controller 130 may determine the initial power ramp rate based on the power management configuration information (e.g., obtained from the power sources 132, as described above), such as based on an amount of power available from the power sources 132 that is indicated by the power management configuration information.

Accordingly, after determining the initial power ramp rate, the controller 130 may cause a power ramp rate associated with each pump system 104 to have the initial power ramp rate. For example, the controller 130 may send, to a VFD 136 of the pump system 104, a signal (e.g., that indicates the initial power ramp rate), which causes a power ramp rate of a motor 134 of the pump system to have the initial power ramp rate.

The controller 130 (e.g., after causing the power ramp rate associated with the pump system 104 to have the initial power ramp rate) may determine a frequency of the power bus 202 and/or may obtain a measurement of the frequency of the power bus 202. For example, the controller 130 may communicate, via the first communication bus 204, with the power sources 132 and/or may communicate, via the second communication bus 206, with the pump system 104 (e.g., the VFD 136 of the pump system 104) to obtain information indicating the frequency of the power bus 202. As another example, the controller 130 may obtain the measurement of the frequency of the power bus 202 from a sensor 208 (e.g., a frequency sensor) configured to detect the frequency of the power bus 202. The sensor 208 may be located at a position on the power bus 202, and the controller 130 may obtain the measurement of the frequency of the power bus 202 from the sensor 208 via a communication bus 210.

The controller 130 may monitor the frequency of the power bus 202. For example, the controller 130 may monitor the frequency of the power bus 202 during the ramp up period of the fluid pump 108 and/or after causing the power ramp rate associated with pump system 104 to have the initial power ramp rate. As described herein, the ramp up period of the fluid pump 108 may be initiated when the controller 130 obtains the commanded flow rate for the fluid pump 108. To monitor the frequency of the power bus 202, the controller 130 may determine the frequency of the power bus 202 (e.g., based on communicating with the one or more power sources 132, communicating with the pump system, and/or obtaining the measurement of the frequency from the sensor 208), at one or more time points (e.g., periodically, aperiodically, or the like). A length of time between the one or more time points may be, for example, less than or equal to a second, a tenth of a second, a hundredth of a second, and/or a thousandth of a second.

The controller 130 may cause (e.g., based on monitoring the frequency of the power bus 202) the power ramp rate associated with the pump system 104 to be modified. For example, the controller 130 may determine (e.g., based on monitoring the frequency of the power bus 202) an intermediate power ramp rate (e.g., that is different than the initial power ramp rate) and thereby cause the power ramp rate associated with the pump system 104 to have the intermediate power ramp rate (e.g., cause the power ramp rate of the motor 134 of the pump system 104 to have the intermediate power ramp rate). The controller 130 may cause the power ramp rate associated with the pump system 104 to be modified one or more times during the ramp up period of the fluid pump 108 and/or after causing the power ramp rate associated with pump system 104 to have the initial power ramp rate.

In another example, the controller 130 may determine (e.g., based on monitoring the frequency of the power bus 202) whether the frequency of the power bus 202 satisfies (e.g., is less than or equal to) a frequency threshold. The frequency threshold may be less than or equal to an optimal frequency of the power bus 202, such as less than or equal to 60 hertz (Hz). The controller 130, based on determining that the frequency of the power bus 202 satisfies the frequency threshold, may cause a decrease of the power ramp rate associated with the pump system 104 (e.g., cause the power ramp rate of the motor 134 of the pump system 104 to decrease, such as to decrease to less than the initial power ramp rate). Alternatively, the controller 130, based on determining that the frequency of the power bus 202 does not satisfy the frequency threshold, may cause an increase of the power ramp rate associated with the pump system 104 (e.g., cause the power ramp rate of the motor 134 of the pump system 104 to increase). The controller 130 may cause the power ramp rate associated with the pump system 104 to be increased and/or decreased one or more times during the ramp up period of the fluid pump 108 and/or after causing the power ramp rate of associated with pump system 104 to have the initial power ramp rate.

To cause modification of the power ramp rate associated with the pump system 104, the controller 130 may send, to the VFD 136 of the power pump system 104, a signal to cause the motor 134 of the pump system 104 to modify (e.g., to increase or decrease) the power ramp rate of the motor 134. In some implementations, modification of the power ramp rate associated with the pump system 104 is to cause a modification of a motor speed ramp rate of the motor 134 of the pump system 104 (e.g., modification of a change in speed, such as in revolutions per minute (RPM), of the motor 134). For example, a decrease of the power ramp rate of the motor 134 is to cause a decrease of the motor speed ramp rate of the motor 134, and an increase of the power ramp rate of the motor 134 is to cause an increase of the motor speed ramp rate of the motor 134.

While some implementations described above are directed to controlling a power ramp rate associated with an individual pump system 104, the controller 130 may also be configured to control some or all of a plurality of pump systems 104. For example, the controller 130 may cause respective power ramp rates associated with a plurality of pump systems 104 to have an initial power ramp rate, and cause (e.g., based on monitoring the frequency of the power bus 202) a power ramp rate associated with at least one pump system 104, of the plurality of pump systems 104, to be modified (e.g., in a similar manner as that described herein). In some implementations, the at least one pump system 104, of the plurality of pump systems 104, does not include at least one other pump system 104, and therefore causing the power ramp rate associated with the at least one pump system 104 to be modified is to not cause the power ramp rate associated with the at least one other pump system 104 to be modified. That is, the controller may cause modification of power ramp rates associated with a first set of pump systems 104, while not causing modification of power ramp rates associated with a second set of pump systems 104.

As indicated above, FIG. 2 is provided as an example. Other examples may differ from what is described with regard to FIG. 2.

Figure 3:
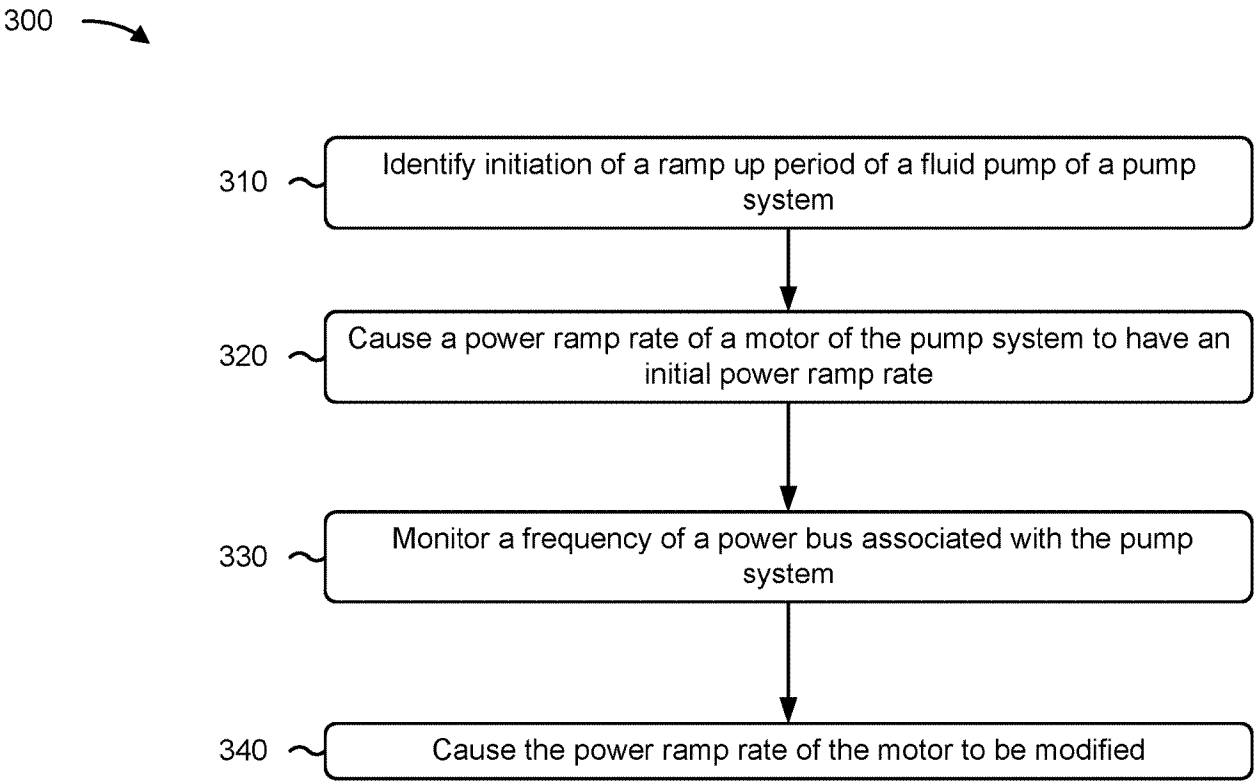
FIG. 3 is a flowchart of an example process relating to controlling a power ramp rate of a motor of a pump system.

FIG. 3 is a flowchart of an example process 300 associated with controlling a power ramp rate of a motor of a pump system. One or more process blocks of FIG. 3 may be performed by a controller (e.g., controller 130). Additionally, or alternatively, one or more process blocks of FIG. 3 may be performed by another device or a group of devices separate from or including the controller, such as another device or component that is internal or external to the hydraulic fracturing system 100. Additionally, or alternatively, one or more process blocks of FIG. 3 may be performed by one or more components of a device, such as a processor, a memory, an input component, an output component, and/or communication component.

Process 300 may include identifying initiation of a ramp up period of a fluid pump of a pump system (block 310). For example, the controller (e.g., using a processor, a memory, a communication component, or the like) may identify initiation of a ramp up period of a fluid pump of a pump system, as described above. Identifying the initiation of the ramp up period of the fluid pump may include obtaining a setting for a flow rate for the fluid pump, and determining, based on the setting for the flow rate for the fluid pump, the initiation of the ramp up period of the fluid pump.

Process 300 may include causing a power ramp rate of a motor of the pump system to have an initial power ramp rate (block 320). For example, the controller (e.g., using a processor, a memory, a communication component, or the like) may cause a power ramp rate of a motor of the pump system to have an initial power ramp rate, as described above. Process 300 may include obtaining, from one or more power sources that provide power to the pump system via the power bus, power management configuration information, and determining, based on the power management configuration information, the initial power ramp rate.

Process 300 may include monitoring a frequency of a power bus associated with the bus system (block 330). For example, the controller (e.g., using a processor, a memory, a communication component or the like) may monitor a frequency of a power bus associated with the bus system, as described above. Monitoring the frequency of the power bus may include at least one of communicating, via a first communication bus, with the one or more power sources to determine the frequency of the power bus; communicating, via a second communication bus, with a variable frequency drive (VFD) of the pump system to determine the frequency of the power bus; or communicating, via a third communication bus, with a sensor to determine the frequency of the power bus.

Process 300 may include causing the power ramp rate of the motor to be modified (block 340). For example, the controller (e.g., using a processor, a memory, a communication component or the like) may cause the power ramp rate of the motor to be modified, as described above. The controller may determine whether the frequency of the power bus satisfies a bus frequency threshold. The controller may cause, based on determining that the frequency of the power bus satisfies the bus frequency threshold, a decrease of the power ramp rate of the motor and/or may cause, based on determining that the frequency of the power bus does not satisfy the bus frequency threshold, an increase of the power ramp rate of the motor. Causing the power ramp rate of the motor to be modified may include sending a signal to the VFD of the pump system, wherein sending the signal to the VFD is to cause the VFD to modify the power ramp rate of the motor.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The control system described herein may be used with any hydraulic fracturing system that pressurizes hydraulic fracturing fluid using motor-driven pumps. For example, the control system may be used with a hydraulic fracturing system that pressurizes hydraulic fracturing fluid using a pump that is driven by a motor that is controlled by a VFD. The control system is useful for detecting an irregularity of the hydraulic fracturing system during a ramp up of the pump, and for decreasing a power ramp rate of a motor that drives the pump if the irregularity is detected, thereby preventing an impending power failure (e.g., a brownout or a blackout). In particular, the control system may detect the irregularity by monitoring a frequency of a power bus that transmits power provided by one or more power sources to a pump system that includes the motor and pump, and the control system may automatically decrease the power ramp rate of the motor if the frequency drops significantly below an optimal frequency (e.g., 60 Hz), thereby reducing an instantaneous power demand of the motor. Moreover, the control system may decrease the power ramp rate of the motor by communicating with a VFD associated with the motor and the pump. In this way, the control system may prevent an impending power failure without controlling an amount of power supplied by the one or more power sources.

Thus, the control system provides improved control of a power demand of the hydraulic fracturing system and reduces a likelihood that a power failure will occur. Accordingly, the control system may prevent uncontrolled shutdown of the hydraulic fracturing system and/or one or more components of the hydraulic fracturing system, thereby preventing damage to the hydraulic fracturing system, the one or more components of the hydraulic fracturing system, a well, or the like. Moreover, the control system improves an uptime of the hydraulic fracturing system.

Further, the control system provides dynamic control of the power ramp rate of the motor (e.g., by decreasing and/or increasing the power ramp rate) based on real-time, or near real-time, power conditions of the hydraulic fracturing system. Accordingly, the power ramp rate of the motor can exceed that of a power ramp rate limit implemented by a conventional hydraulic fracturing system, with minimal risk of causing a power failure. This enables the motor, and the pump driven by the motor, to have an improved performance as compared to an engine, transmission, and pump associated with the conventional hydraulic fracturing system.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc., depending on the context.

What is claimed is:

1. A system for hydraulic fracturing, comprising:

a pump system that includes:

a fluid pump, a motor configured to drive the fluid pump, and a variable frequency drive (VFD) configured to control the motor;

one or more power sources configured to provide power to the pump system via a power bus; and a controller configured to:

identify initiation of a ramp up period of the fluid pump;

cause, based on identifying the initiation of the ramp up period of the fluid pump and via the VFD, a power ramp rate of the motor to have an initial power ramp rate;

monitor, during the ramp up period of the fluid pump, a frequency of the power bus;

determine, based on monitoring the frequency of the power bus, whether the frequency of the power bus satisfies a frequency threshold; and cause, based on determining that the frequency of the power bus satisfies the frequency threshold, and via the VFD, a decrease of the power ramp rate of the motor.

2. The system of claim 1, wherein the controller is further configured to:

determine, after causing the decrease of the power ramp rate of the motor and based on monitoring the frequency of the power bus, whether the frequency of the power bus ceases to satisfy the frequency threshold; and cause, based on determining that the frequency of the power bus ceases to satisfy the frequency threshold and via the VFD, an increase of the power ramp rate of the motor.

3. The system of claim 1, wherein the one or more power sources includes at least one of:

an electrical grid, one or more turbines, one or more generator sets, one or more energy storage devices, or one or more renewable energy systems.

4. The system of claim 1, wherein the controller, to cause the decrease of the power ramp rate of the motor, is configured to:

send, to the VFD, a signal that causes the VFD to decrease the power ramp rate of the motor.

5. The system of claim 1, wherein the controller is further configured to:

obtain, from the one or more power sources, prior to causing the power ramp rate of the motor to have the initial power ramp rate, power management configuration information; and determine, based on the power management configuration information, the initial power ramp rate.

6. The system of claim 1, wherein the controller, to identify the initiation of the ramp up period of the fluid pump, is configured to:

obtain a setting for a flow rate for the fluid pump; and determine, based on the setting for the flow rate for the fluid pump, the initiation of the ramp up period of the fluid pump.

7. The system of claim 1, wherein the controller, to monitor the frequency of the power bus, is configured to at least one of:

determine, based on communicating with the one or more power sources via a first communication bus, the frequency of the power bus;

determine, based on communicating with the VFD via a second communication bus, the frequency of the power bus; or determine, based on obtaining a measurement from a sensor, the frequency of the power bus.

8. The system of claim 1, wherein the decrease of the power ramp rate of the motor is to cause a decrease of a motor speed ramp rate of the motor.

9. A method, comprising:

identifying, by a controller associated with a pump system, initiation of a ramp up period of a fluid pump of the pump system;

causing, by the controller, a power ramp rate of a motor of the pump system to have an initial power ramp rate;

monitoring, by the controller and after causing the power ramp rate of the motor to have the initial power ramp rate, a frequency of a power bus, wherein one or more power sources provide power to the pump system via the power bus; and causing, based on monitoring the frequency of the power bus and based on a frequency threshold, the power ramp rate of the motor to be modified, wherein causing the power ramp rate of the motor to be modified comprises:

sending a signal, to a variable frequency drive (VFD) of the pump system, that causes the VFD to modify the power ramp rate of the motor.

10. The method of claim 9, wherein sending the signal comprises:

determining, based on monitoring the frequency of the power bus, whether the frequency of the power bus satisfies the frequency threshold; and sending, based on determining that the frequency of the power bus satisfies the frequency threshold, the signal to decrease the power ramp rate of the motor.

11. The method of claim 9, wherein sending the signal comprises:

determining, based on monitoring the frequency of the power bus, whether the frequency of the power bus satisfies the frequency threshold; and sending, based on determining that the frequency of the power bus does not satisfy the frequency threshold, the signal to increase the power ramp rate of the motor.

12. The method of claim 9, further comprising:

obtaining, from the one or more power sources, power management configuration information; and determining, based on the power management configuration information, the initial power ramp rate.

13. The method of claim 9, wherein monitoring the frequency of the power bus comprises at least one of:

communicating, via a first communication bus, with the one or more power sources to determine the frequency of the power bus;

communicating, via a second communication bus, with the variable frequency drive (VFD) of the pump system to determine the frequency of the power bus; or communicating, via a third communication bus, with a sensor to determine the frequency of the power bus.

14. The method of claim 9, further comprising:

determining that the frequency of the power bus ceases to satisfy the frequency threshold; and causing, based on determining that the frequency of the power bus ceases to satisfy the frequency threshold and via the VFD, an increase of the power ramp rate of the motor.

15. A controller, comprising:

one or more memories; and one or more processors configured to:

identify initiation of a ramp up period of a fluid pump of a pump system of plurality of pump systems;

cause respective power ramp rates associated with the plurality of pump systems to have an initial power ramp rate;

monitor, by the controller and after causing the respective power ramp rates associated with the plurality of pump systems to have the initial power ramp rate, a frequency of a power bus, wherein one or more power sources provide power to the plurality of pump systems via the power bus; and cause, based on monitoring the frequency of the power bus and based on a frequency threshold, a power ramp rate associated with at least the pump system to be modified, wherein, to cause the power ramp rate to be modified, the one or more processors are configured to:

send a signal, to a variable frequency drive (VFD) of the pump system, that causes the VFD to modify the power ramp rate.

16. The controller of claim 15, wherein, when the frequency of the power bus satisfies the frequency threshold, the signal is to cause a decrease of the power ramp rate associated with at least the pump system.

17. The controller of claim 15, wherein, when the frequency of the power bus does not satisfy the frequency threshold, the signal is to cause an increase of the power ramp rate associated with at least the pump system.

18. The controller of claim 15, wherein the one or more processors, to send the signal, are configured to:

determine, based on monitoring the frequency of the power bus, an intermediate power ramp rate; and send the signal to cause, based on determining the intermediate power ramp rate, the power ramp rate associated with at least the pump system to have the intermediate power ramp rate.

19. The controller of claim 15, wherein causing the power ramp rate associated with at least the pump system being modified does not cause a power ramp rate associated with at least one other pump system, of the plurality of pump systems, to be modified.

20. The controller of claim 15, wherein the one or more processors are further configured to:

determine, based on an artificial intelligence model, the initial power ramp rate.

* * * * *